US011482374B2

(12) United States Patent
Satou

(10) Patent No.: US 11,482,374 B2
(45) Date of Patent: Oct. 25, 2022

(54) INDUCTOR COMPONENT AND METHOD FOR MANUFACTURING SAME

(71) Applicant: Panasonic Intellectual Property Management Co., Ltd., Osaka (JP)

(72) Inventor: Manabu Satou, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 462 days.

(21) Appl. No.: 16/608,665

(22) PCT Filed: Jun. 21, 2018

(86) PCT No.: PCT/JP2018/023564
§ 371 (c)(1),
(2) Date: Oct. 25, 2019

(87) PCT Pub. No.: WO2019/004038
PCT Pub. Date: Jan. 3, 2019

(65) Prior Publication Data

US 2020/0303115 A1 Sep. 24, 2020

(30) Foreign Application Priority Data

Jun. 29, 2017 (JP) ..... JP2017-126884

(51) Int. Cl.
*H01F 41/02* (2006.01)
*H01F 27/29* (2006.01)
(Continued)

(52) U.S. Cl.
CPC ..... *H01F 27/29* (2013.01); *H01F 27/24* (2013.01); *H01F 27/2823* (2013.01);
(Continued)

(58) Field of Classification Search
CPC .. H01F 2017/048; H01F 27/306; H01F 41/10; H01F 27/022; H01F 41/04;
(Continued)

(56) References Cited

U.S. PATENT DOCUMENTS 8,188,824 B2 * 5/2012 Yan ..... H01F 27/292 336/192
9,177,720 B2 * 11/2015 Yamada ..... H01F 27/29

FOREIGN PATENT DOCUMENTS

CN 101552106 A 10/2009
CN 102290208 A 12/2011
(Continued)

OTHER PUBLICATIONS

International Search Report of PCT application No. PCT/JP2018/023564 dated Sep. 18, 2018.
(Continued)

*Primary Examiner* — Thiem D Phan
(74) *Attorney, Agent, or Firm* — McDermott Will & Emery LLP

(57) ABSTRACT

The inductor component includes: coil portion around which lead wire is wound; lead-out portion at which an end portion of the lead wire is led out; connection line portion to which the lead-out portion is connected; outer terminal portion integrally formed with the connection line portion; and mold body which contains a magnetic material and in which the coil portion and the connection line portion are embedded. The connection line portion has a shape elongating along the lead-out portion, and includes a pair of first bonding pieces between the coil portion and terminal of the lead-out portion, the pair of first bonding pieces elongating from both sides of the connection line portion in mutually opposite directions. The pair of first bonding pieces has distal end sides each
(Continued)

folded toward a part of the lead-out portion on the opposite side from the connection line portion.

6 Claims, 15 Drawing Sheets

(51) Int. Cl.
*H01F 27/24* (2006.01)
*H01F 27/28* (2006.01)
*H01F 41/04* (2006.01)

(52) U.S. Cl.
CPC ..... *H01F 41/0206* (2013.01); *H01F 41/04* (2013.01); *Y10T 29/49069* (2015.01)

(58) Field of Classification Search
CPC ..... H01F 27/28; Y10T 29/49071; Y10T 29/49069; H01L 28/10
USPC ..... 29/604, 602.1, 605, 606, 729, 737
See application file for complete search history.

(56) References Cited

FOREIGN PATENT DOCUMENTS

| | | |
|---|---|---|
| CN | 104465034 A | 3/2015 |
| JP | 62-005878 | 1/1987 |
| JP | 6-031472 | 2/1994 |
| JP | 2004-103862 | 4/2004 |
| JP | 2007-081120 | 3/2007 |
| JP | 2007-258201 | 10/2007 |

OTHER PUBLICATIONS

English Translation of Chinese Office Action dated Aug. 1, 2022 for the related Chinese Patent Application No. 201880034405.3.

* cited by examiner

INDUCTOR COMPONENT AND METHOD FOR MANUFACTURING SAME

FIELD OF THE INVENTION

The present disclosure relates to an inductor component used for various electronic devices and a method for manufacturing the inductor component.

DESCRIPTION OF THE RELATED ART

Conventionally, reduction in size of an inductor component has been proposed in comparison with an inductor component that uses a configuration in which a lead wire of a coil of the inductor component is welded and bonded with a metal terminal to connect the lead wire to the metal terminal for wiring.

The conventional inductor component as described above will be described with reference to the drawing.

FIG. 16 is a transparent perspective view showing conventional inductor component 5. In FIG. 16, broken lines indicate an inside of block body 6 described later.

As shown in FIG. 16, the conventional inductor component includes lead wire 1 having a cross section with a diameter of 0.6 mm to 1.5 mm and wound to form coil 2 having an area of approximately 13 mm×13 mm. Terminal portion 3 of the lead wire of coil 2 is connected, by means of arc welding, to metal terminal 4 that is to be connected to an outer circuit to thereby configure inductor component 5.

Then coil 2, terminal portion 3 of the lead wire of coil 2, and the welded part of metal terminal 4 are embedded inside block body 6 containing a magnetic material and an outer connecting part of metal terminal 4 is exposed to an outside of block body 6 to configure coil-embedded inductor component 5 in which coil 2 is embedded in a magnetic body.

As citation list information relating to the invention of the present application, PTL 1 is known, for example.

CITATION LIST

Patent Literature

PTL 1: Unexamined Japanese Patent Publication No. 2004-103862

SUMMARY OF THE INVENTION

In recent years, as electronic devices have become smaller and smaller, inductor components have been required to be further miniaturized. For example, a coil-embedded inductor component is required to be miniaturized to have an area of 4 mm×4 mm, for example. For such a small inductor component, a small coil needs to be formed using a thin lead wire having a cross section with a diameter of approximately 0.1 mm to 0.3 mm.

When a coil is made smaller using a thin lead wire as described above, an area of a connecting part between the lead wire and a metal terminal becomes smaller. Accordingly, connecting strength is likely to be unstable between the lead wire and the metal terminal. In particular, in a case where a coil-embedded inductor component is formed, the lead wire of the connecting part receives stress during formation of a magnetic material. As a result, the lead wire may come off and thus connecting reliability may be decreased.

In addition, in a case where the lead wire is welded to the metal terminal by means of arc welding, since the coil is small, heat during fusion is easily transferred to the coil. As a result, an insulating film of the lead wire may be thermally deteriorated and thus reliability may be decreased.

It is an object of the present disclosure to provide an inductor component that suppresses a decrease in reliability due to miniaturization of an inductor component, and a method for manufacturing the inductor component.

The present disclosure includes the following configuration to solve the problem described above. That is, the configuration of the inductor component of the present disclosure includes a coil portion, a lead-out portion, a connection line portion, a terminal electrode and a mold body. The lead wire is wound around the coil portion. An end portion of the lead wire is led out in an outer direction of the coil portion at the lead-out portion. The connection line portion is made of a metal plate and the lead-out portion is connected to the connection line portion. The terminal electrode has an outer terminal portion that is integrally formed with the connection line portion and is to be connected to an outer circuit. The mold body contains a magnetic material, the coil portion and the connection line portion are embedded in the mold body, and the outer terminal portion is exposed from the mold body. The connection line portion has a shape elongating along the lead-out portion. The connection line portion also includes a pair of first bonding pieces between the coil portion and a terminal of the lead-out portion, the pair of first bonding pieces elongating from both sides of the connection line portion in mutually opposite directions. The pair of first bonding pieces has distal end sides each folded toward a part of the lead-out portion on the opposite side from the connection line portion. The lead-out portion and the connection line portion are connected by means of fusion bonding between the part of the lead-out portion on the opposite side from the connection line portion and distal end parts of the first bonding pieces. Moreover, the lead-out portion and the connection line portion are connected by means of welding between the terminal of the lead-out portion and the connection line portion.

In addition, the method for manufacturing the inductor component of the present disclosure includes steps shown below. That is, the method includes a step of forming a coil portion around which a lead wire is wound, and forming a lead-out portion from which an end portion of the lead wire is led out in an outer direction of the coil portion. The method includes a step of forming a terminal electrode through die-cutting of a metal plate, the terminal electrode having a connection line portion to which the lead-out portion is connected and an outer terminal portion to be connected to an outer circuit integrally with the connection line portion. The method includes a step of locking the lead-out portion at the connection line portion. The method includes a step of connecting the lead-out portion to the connection line portion. In addition, the method includes a step of forming a mold body containing a magnetic material, in which the coil portion and the connection line portion are embedded and from which the outer terminal portion is exposed. The connection line portion elongates along the lead-out portion. Moreover, the connection line portion is formed into a shape having a pair of first bonding pieces in a position corresponding to a position between the coil portion and a terminal of the lead-out portion, the pair of first bonding pieces elongating from both sides of the connection line portion in mutually opposite directions. In the step of locking the lead-out portion at the connection line portion, distal end sides of the pair of first bonding pieces are each folded toward a part of the lead-out portion on the opposite side from the connection line portion so as to lock the lead-out portion at the connection line portion. In the step of connecting the lead-out portion to the connection line portion, the part of the lead-out portion on the opposite side from the connection line portion is welded with the distal end part of the first bonding piece by means of laser welding. After this connection, the terminal of the lead-out portion and the connection line portion are welded and connected by means of laser welding.

According to the configuration described above, the connection line portion has a shape elongating along the lead-out portion. Therefore, the pair of first bonding pieces can be provided between the coil portion and the terminal of the lead-out portion, the pair of first bonding pieces elongating from both sides of the connection line portion in mutually opposite directions. Further, the distal end sides of the pair of first bonding pieces are each folded toward the part of the lead-out portion on the opposite side from the connection line portion. Therefore, the part of the lead-out portion on the opposite side from the connection line portion and the distal end part of the first bonding piece can be welded and partially connected.

In addition, on a terminal side of the lead-out portion, the terminal of the lead-out portion and the connection line portion are melted to connect the lead-out portion to the connection line portion entirely.

Since the connection line portion has two connecting parts in which the lead-out portion is bonded, the two connecting parts complement each other to prevent the lead-out portion from coming off of the connection line portion.

In addition, the connecting part on a side close to the coil portion serves as a connecting part in which the distal end part of the first bonding piece and the part of the lead-out portion on the opposite side from the connection line portion are melted and partially welded. Therefore, an amount of heat during bonding can be reduced in comparison with a connecting part in which the lead-out portion on the terminal side of the lead-out portion and the connection line portion are entirely welded and connected. As a result, deterioration in the insulating film of the lead wire can be suppressed.

Moreover, in the manufacturing method of the present disclosure, in particular, in the step of connecting the lead-out portion and the connection line portion, the part of the lead-out portion on the opposite side from the connection line portion is welded and connected to the distal end part of the first bonding piece by means of laser welding. After this connection, the terminal of the lead-out portion and the connection line portion are welded and connected by means of laser welding.

By so doing, heat generated during laser welding of the entirety of the terminal of the lead-out portion and the connection line portion is released into the terminal electrode through the connection line portion from the part of the lead-out portion on the opposite side from the connection line portion that has been connected earlier, and the connecting part of the distal end part of the first bonding piece. As a result, deterioration in the insulating film of the lead wire can be further suppressed.

DETAILED DESCRIPTION OF THE PREFERRED EMBODIMENTS

Hereinafter, an inductor component according to an exemplary embodiment of the present disclosure will be described with reference to FIGS. 1 to 4.

Figure 1:
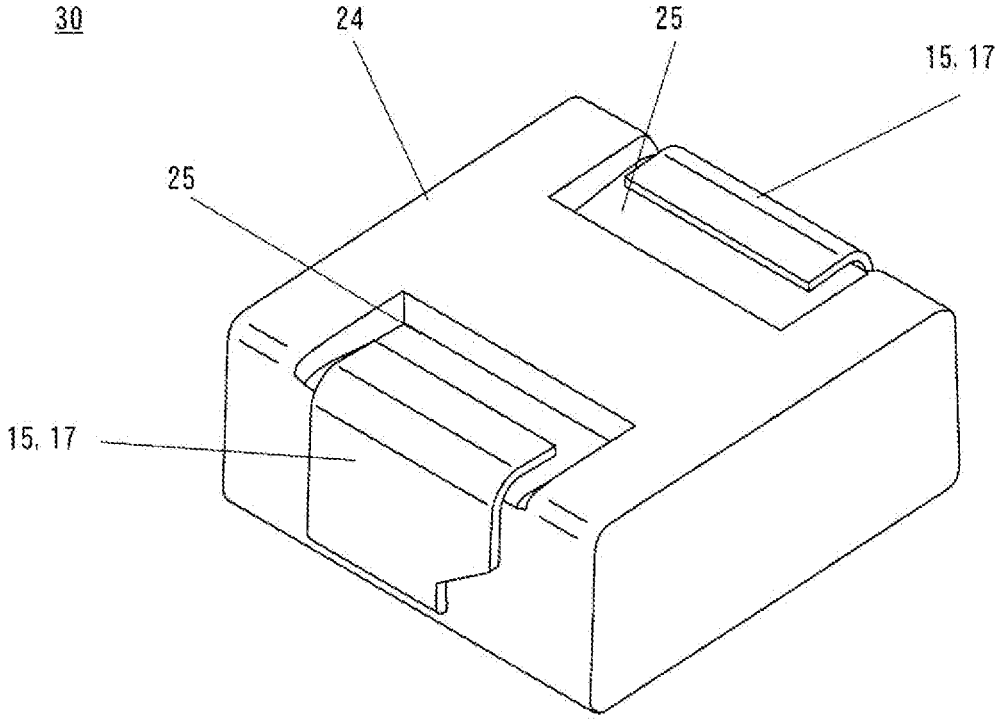
FIG. 1 is a perspective view of a bottom surface side of an inductor component according to an exemplary embodiment of the present disclosure.
Figure 2:
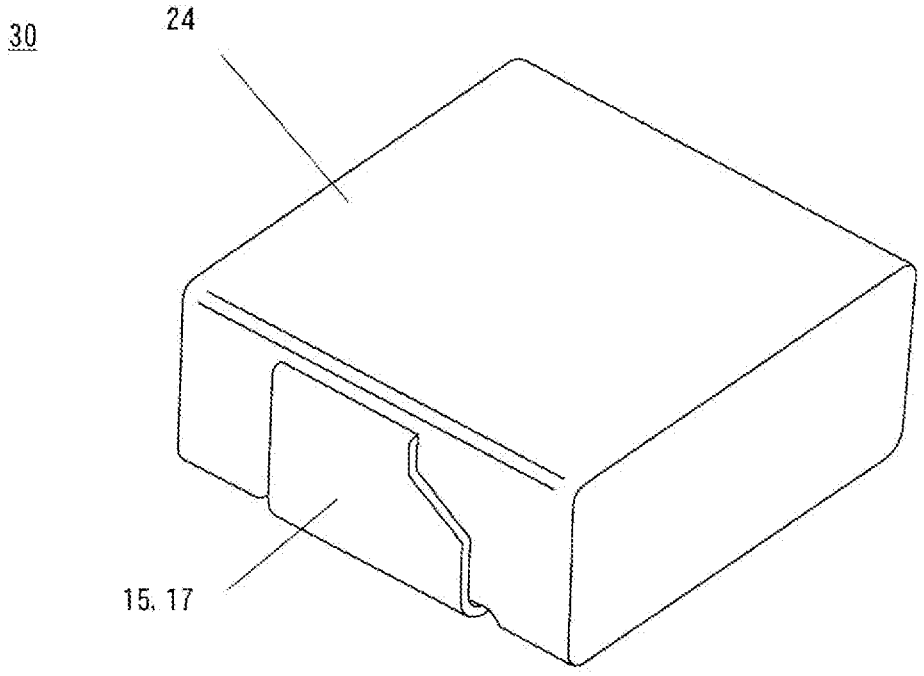
FIG. 2 is a perspective view of a top surface side of the inductor component according to the exemplary embodiment of the present disclosure.
Figure 3:
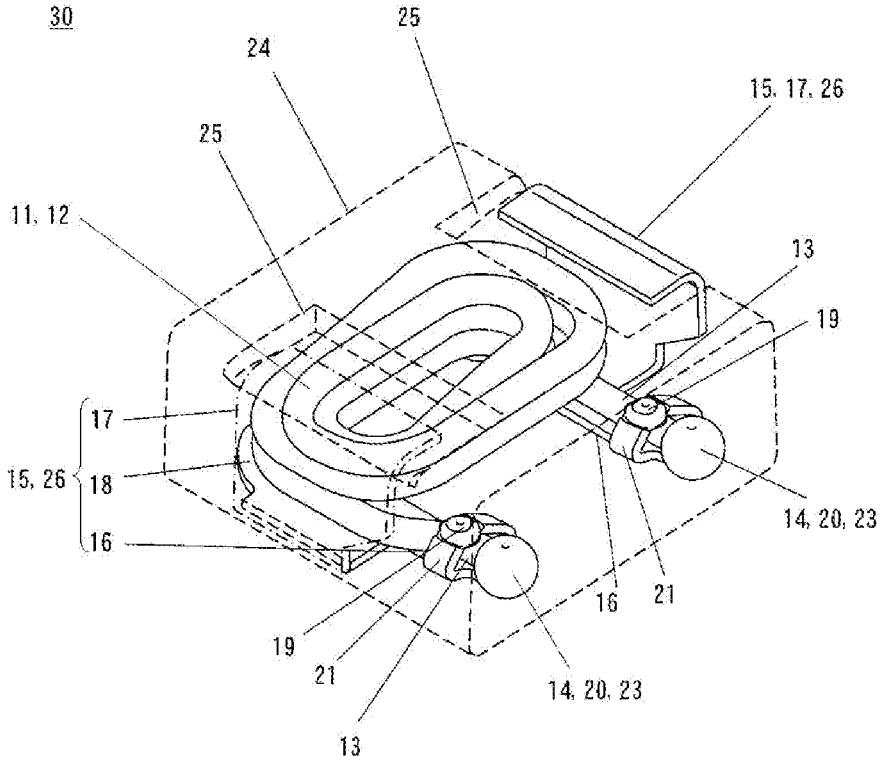
FIG. 3 is a transparent perspective view of the bottom surface side of the inductor component according to the exemplary embodiment of the present disclosure.
Figure 4:
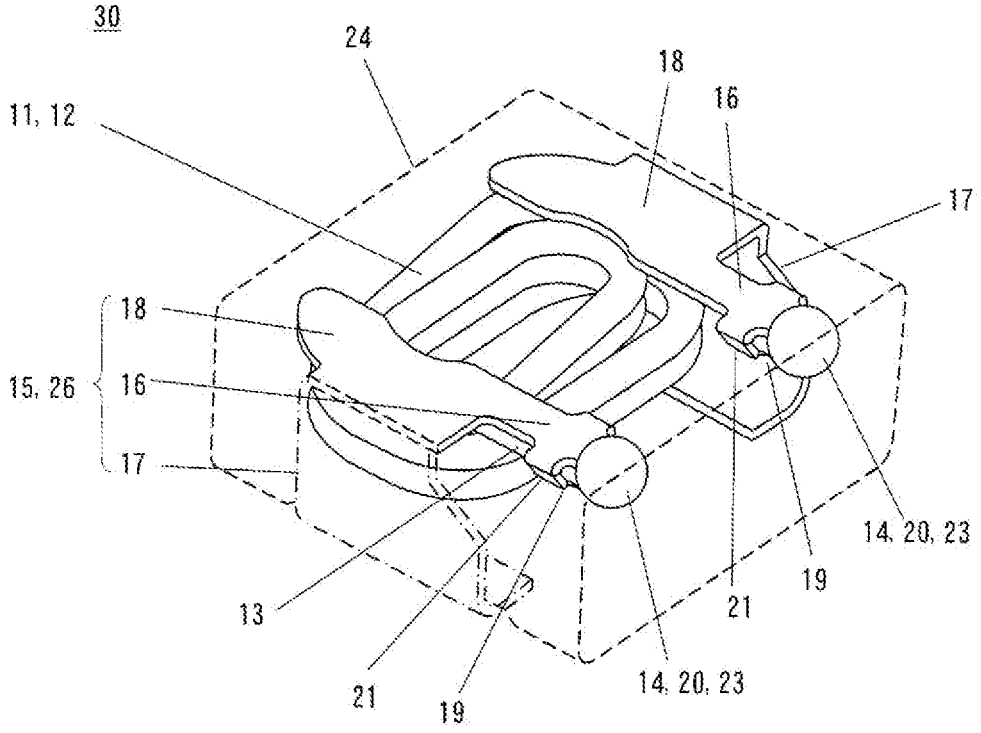
FIG. 4 is a transparent perspective view of the top surface side of the inductor component according to the exemplary embodiment of the present disclosure.

Note that FIGS. 3 and 4 are transparent perspective views that transparently show mold body 24 described later. Broken lines indicate a contour of mold body 24. Moreover, for facilitating the understanding of the configuration of the inductor component, in FIGS. 3 and 4, between a pair of outer terminal portions 17 described later, outer terminal portion 17 on a front side of the drawing is transparently shown and a contour of that outer terminal portion 17 is indicated with one-dot chain lines.

As shown in FIGS. 1 to 4, inductor component 30 of the present exemplary embodiment includes coil portion 11 around which lead wire 12 with an insulating film is wound, lead-out portion 13 at which each end portion of lead wire 12 from which the insulating film has been removed is led out in the outer direction of coil portion 11, connection line portion 16 which is made of metal plate 26 and to which lead-out portion 13 is connected, and a pair of terminal electrodes 15 each having outer terminal portion 17 which is integrally formed with connection line portion 16 and is to be connected to an outer circuit.

Coil portion 11, lead-out portion 13, and connection line portion 16 are embedded in mold body 24 containing soft magnetic body powder and resin, and a part of outer terminal portion 17 is exposed from mold body 24 to configure a coil-embedded inductor component 30 in which coil portion 11 is embedded in mold body 24 containing a magnetic material.

Among the components described above, coil portion 11 is formed with lead wire 12 with an insulating film made of polyamide-imide or the like wound in such a manner that a winding core of lead wire 12 is formed into an elliptic shape. The shape of the winding core is not limited to an elliptic shape, but may be a circular or square shape.

With regard to a diameter dimension of a cross section of lead wire 12 that forms coil portion 11, in a case of a small inductor component including mold body 24 having a dimension equivalent to a dimension of 4 mm×4 mm in plan view, for example, thin lead wire 12 having a diameter of approximately 0.1 mm to 0.3 mm is used and wound to form coil portion 11.

When coil portion 11 is viewed in plan view in a direction of a winding axis (viewed from an upper side of the drawing in FIG. 3), both end portions of lead wire 12 of coil portion 11 are led out in the outer direction of coil portion 11 to form lead-out portions 13. The insulating film of lead wire 12 in a portion led out is peeled off and removed.

Lead-out portion 13 is led out from inside with respect to a longitudinal outside dimension of coil portion 11, which has been formed into an elliptic shape, in the same direction as a transverse direction of coil portion 11.

Terminal electrode 15 is made of a metal plate having a thickness of 0.1 mm and containing phosphor bronze or pure copper. Terminal electrode 15 includes connection line portion 16 to which lead-out portion 13 is to be connected, coil fixing portion 18 which is to be linked to connection line portion 16 and on which coil portion 11 is to be fixed, and outer terminal portion 17 which is linked to coil fixing portion 18 and is to be connected to an outer circuit. Connection line portion 16, coil fixing portion 18, and outer terminal portion 17 are integrally formed.

Outer terminal portion 17 is properly processed in accordance with a form for connection with the outer circuit.

In the example of coil-embedded inductor component 30 shown in FIGS. 1 to 4, outer terminal portion 17 protrudes and is exposed from a side of mold body 24, is folded toward the bottom surface from the side of mold body 24, is disposed in accommodating recessed portion 25 formed on the bottom surface of mold body 24 to accommodate outer terminal portion 17, and is processed into surface-mounted outer terminal portion 17.

Coil fixing portion 18 is formed into a shape along a part of a shape of coil portion 11 and coil portion 11 is fixed on coil fixing portion 18 with adhesive 27 or the like. In the example shown in FIGS. 3 and 4, coil fixing portion 18 is formed into a shape along a part of coil portion 11 in the transverse direction, coil portion 11 being formed into an elliptic shape.

Connection line portion 16 is linked to coil fixing portion 18 and is formed into a shape elongating along lead-out portion 13.

Further, connection line portion 16 includes a pair of first bonding pieces 21 between coil portion 11 and terminal 14 of lead-out portion 13, the pair of first bonding pieces 21 elongating from both sides of connection line portion 16 in mutually opposite directions and away from each other. The pair of first bonding pieces 21 has distal end sides each folded toward a part of lead-out portion 13 on the opposite side from connection line portion 16.

Lead-out portion 13 and connection line portion 16 are connected by first bonding portion 19 in which the part of lead-out portion 13 on the opposite side from connection line portion 16 and a distal end part of first bonding piece 21 are partially welded.

In addition, lead-out portion 13 and connection line portion 16 are also connected by second bonding portion 20 in which terminal 14 of lead-out portion 13 and connection line portion 16 are entirely welded.

Here, being "welded" refers to a state in which portions are welded by means of laser irradiation or the like.

As described above, connection line portion 16 has a shape elongating along lead-out portion 13. Therefore, first bonding portion 19 can be formed as follows: the pair of first bonding pieces 21 is provided between coil portion 11 and terminal 14 of lead-out portion 13, the pair of first bonding pieces 21 elongating from both sides of connection line portion 16 in mutually opposite directions, the distal end sides of the pair of first bonding pieces 21 are each folded toward a part of lead-out portion 13 on the opposite side from connection line portion 16, and the part of lead-out portion 13 on the opposite side from connection line portion 16 and the distal end part of first bonding piece 21 are partially welded and connected.

In addition, on the side of terminal 14 of lead-out portion 13, second bonding portion 20 can be formed, in which terminal 14 of lead-out portion 13 and connection line portion 16 are entirely welded and connected.

As described above, since connection line portion 16 has two connecting parts, i.e., first bonding portion 19 and second bonding portion 20, in which lead-out portion 13 is bonded, the two connecting parts complement each other to prevent lead-out portion 13 from coming off of connection line portion 16. As a result, connecting strength can be improved.

In this case, only a part of lead-out portion 13 and the distal end part of first bonding piece 21 are welded and connected to each other in first bonding portion 19. Therefore, connecting strength of first bonding portion 19 is low.

However, since first bonding portion 19 is located between second bonding portion 20 in which lead-out portion 13 and connection line portion 16 are entirely welded and connected, and coil portion 11 from which lead-out portion 13 is led out, first bonding portion 19 does not easily come off. Conversely, this configuration can prevent second bonding portion 20 from coming off.

In addition, first bonding portion 19 on a side close to coil portion 11 serves as a connecting part in which the distal end part of first bonding piece 21 and the part of lead-out portion 13 on the opposite side from connection line portion 16 are melted and partially welded. Therefore, an amount of heat during bonding can be reduced in comparison with a connecting part in which lead-out portion 13 of second bonding portion 20 on the side of terminal 14 of lead-out portion 13 and connection line portion 16 are entirely welded. As a result, deterioration in the insulating film of lead wire 12 can be suppressed.

Figure 5A:
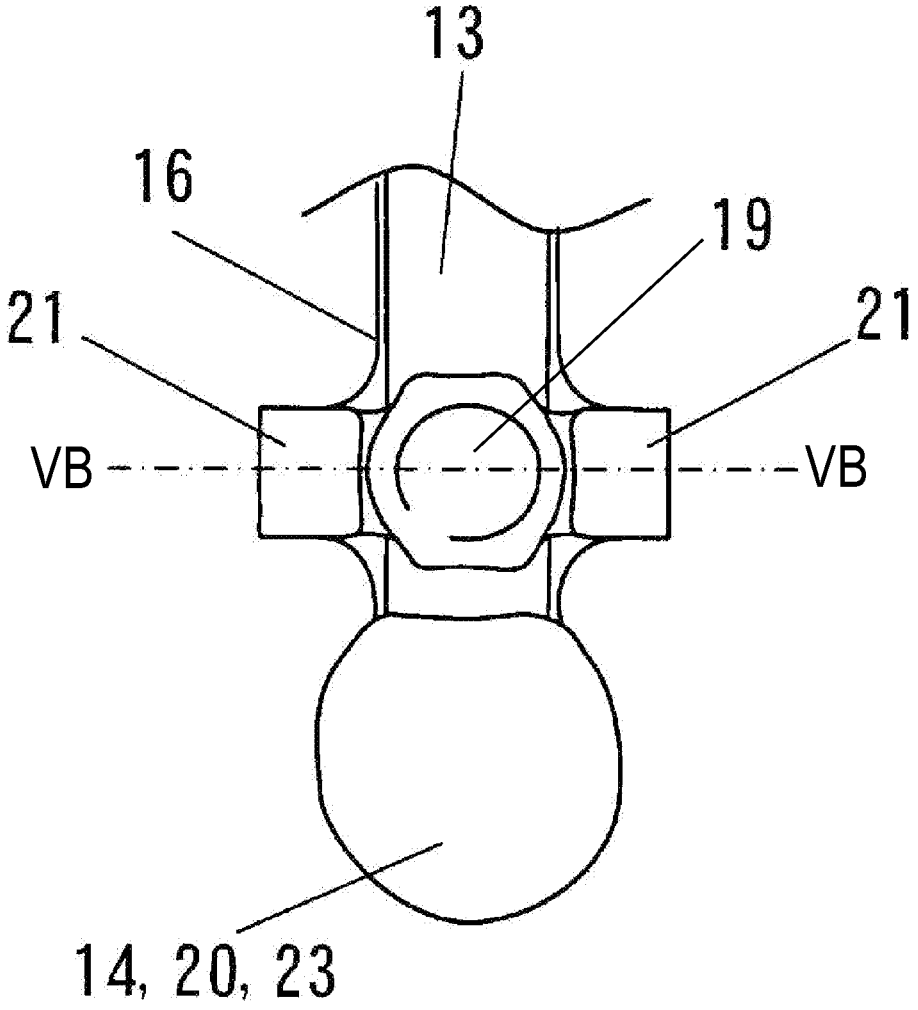
FIG. 5A is an enlarged plan view of a lead-out portion and a connection line portion in FIG. 3.
Figure 5B:
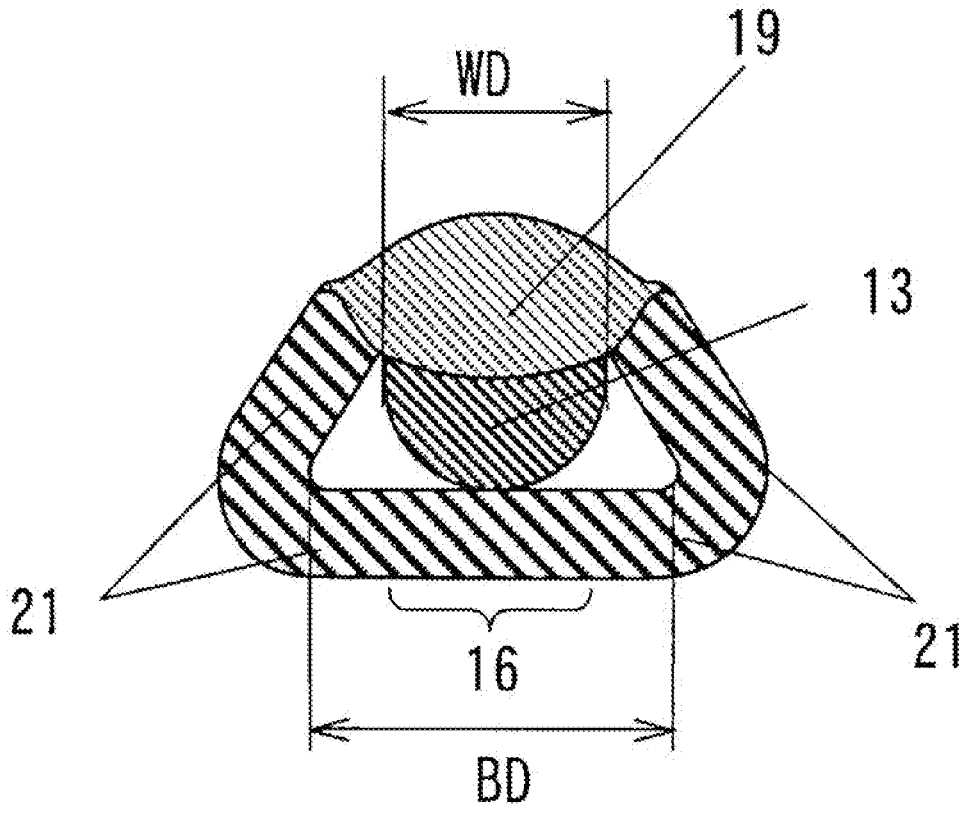
FIG. 5B is a cross-sectional view taken along line VB-VB of FIG. 5A.

In addition, as shown in FIGS. 5A and 5B, dimension BD of an inner part between parts respectively folded of the pair of first bonding pieces 21 is set to be larger than maximum dimension WD of lead-out portion 13 in an extending direction of first bonding pieces 21.

Here, FIG. 5A is a partially enlarged view of lead-out portion 13 and connection line portion 16, and is a plan view of lead-out portion 13 viewed from the opposite side of connection line portion 16. Moreover, FIG. 5B is a cross-sectional view taken along line VB-VB of FIG. 5A.

By so doing, before first bonding portion 19 is melted and connected, when lead-out portion 13 is viewed from the opposite side of connection line portion 16, the pair of first bonding pieces 21 is folded from both outer sides of lead-out portion 13 so as to protrude toward the inner side of lead-out portion 13. Therefore, since the distal ends of the pair of first bonding pieces 21 come close to each other, when first bonding pieces 21 are bonded with lead-out portion 13, a part to be melted can be made smaller. As a result, the amount of heat during welding can be reduced, and thus heat deterioration in the insulating film of lead wire 12 can be suppressed.

As described above, inductor component 30 of the present exemplary embodiment can suppresses a decrease in reliability due to miniaturization of an inductor component.

In particular, with respect to stress during formation of mold body 24 through embedding of coil portion 11 and connection line portion 16 in a magnetic material containing soft magnetic body powder and resin, two connecting parts, i.e., first bonding portion 19 and second bonding portion 20, prevent lead-out portion 13 from coming off of connection line portion 16. Therefore, even a miniaturized inductor component can configure coil-embedded inductor component 30.

Next, a method for manufacturing inductor component 30 according to the present exemplary embodiment described above will be described with reference to FIGS. 6 to 15.

FIGS. 6 to 15 are views showing steps of manufacturing inductor component 30 according to an exemplary embodiment of the present invention. Note that in FIGS. 6 to 10 and FIGS. 12 to 15, a side that becomes the bottom surface of inductor component 30 is shown as the upper side in the drawings.

Figure 6:
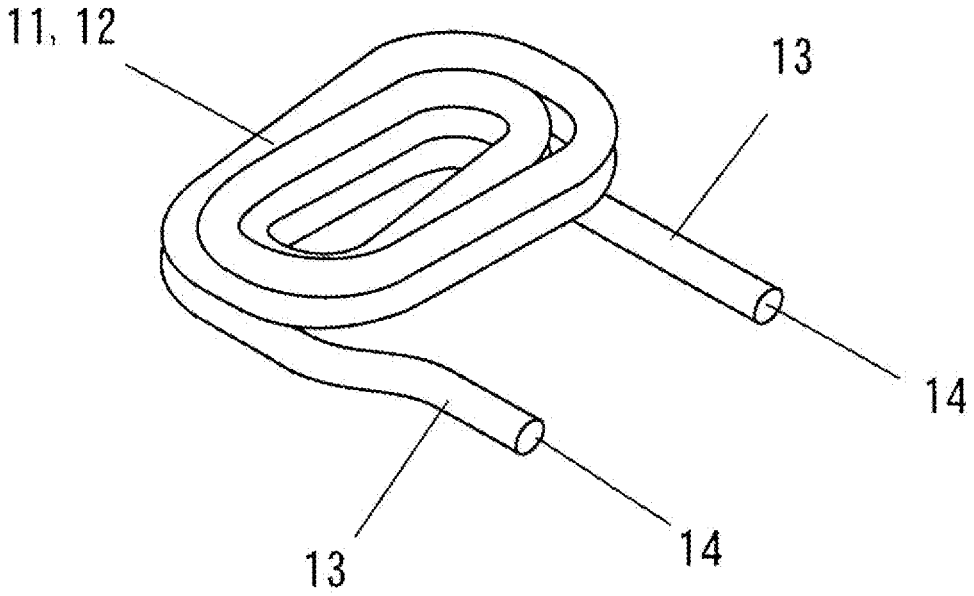
FIG. 6 is a view showing a step of manufacturing the inductor component according to the exemplary embodiment of the present disclosure.

First, as shown in FIG. 6, lead wire 12 with an insulating film made of pure copper and having a circular cross section is wound to form coil portion 11.

Then, the insulating film on both end portions of lead wire 12 is removed, and both end portions are led out in the outer direction of coil portion 11 to form lead-out portions 13.

Coil portion 11 described above is formed into an elliptic shape. Both lead-out portions 13 are led out from inside with respect to a longitudinal outside dimension of coil portion 11 formed into an elliptic shape in the same direction as a transverse direction of coil portion 11.

Figure 7:
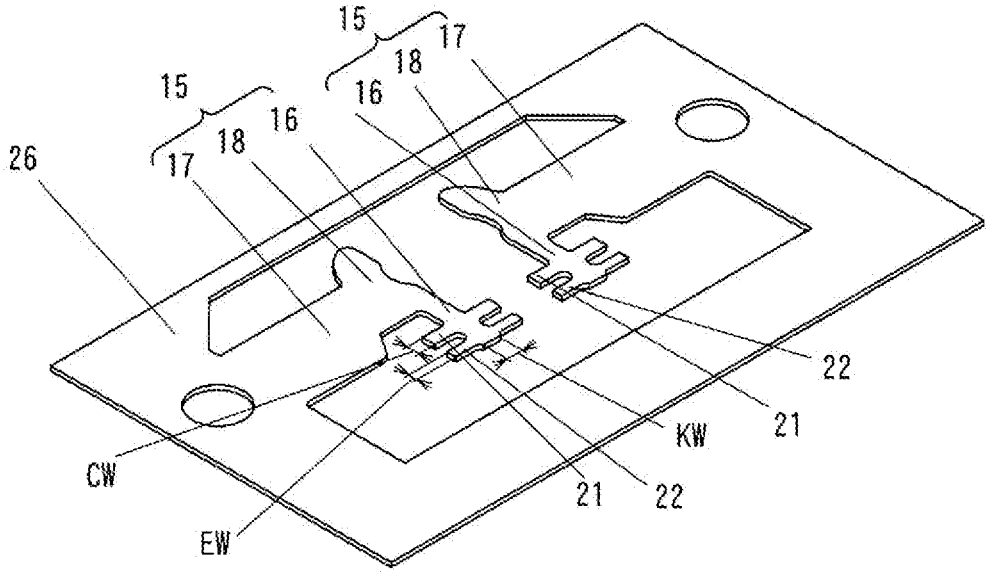
FIG. 7 is a view showing a step of manufacturing the inductor component according to the exemplary embodiment of the present disclosure.

Next, as shown in FIG. 7, a pair of terminal electrodes 15 is formed through die-cutting of metal plate 26.

The pair of terminal electrodes 15 each integrally forms connection line portion 16 to which lead-out portion 13 is connected, coil fixing portion 18 which is linked to connection line portion 16 and on which coil portion 11 is fixed, and outer terminal portion 17 linked to coil fixing portion 18 to be connected to an outer circuit.

Among the components described above, connection line portion 16 is formed in accordance with the position and dimension of lead-out portion 13 of coil portion 11 in advance so as to extend along lead-out portion 13.

Coil fixing portion 18 is formed into a shape along a shape of a part of coil portion 11. In the example shown in FIG. 7, coil fixing portion 18 is formed into a shape along a shape of a part of coil portion 11 in the transverse direction, coil portion 11 being formed into an elliptic shape as shown in FIG. 6.

The pair of outer terminal portions 17 is formed by being elongated from coil fixing portions 18 in mutually opposite directions.

Then, on connection line portion 16, the pair of first bonding pieces 21 is integrally formed with connection line portion 16 in a position corresponding to a position between coil portion 11 and terminal 14 of lead-out portion 13 shown in FIG. 6, the pair of first bonding pieces 21 having a band shape and elongating from both sides of connection line portion 16 in directions mutually opposite and away from each other.

Moreover, on connection line portion 16, the pair of second bonding pieces 22 is integrally formed on the side of terminal 14 of lead-out portion 13 at a space from first bonding piece 21, the pair of second bonding pieces 22 having a band shape and elongting from both sides of connection line portion 16 in mutually opposite directions.

In the example shown in FIG. 7, first bonding piece 21 and second bonding piece 22 are formed in a direction orthogonal to an elongtiong direction of connection line portion 16.

Then, width dimension CW of first bonding piece 21 having a band shape and width dimension EW of second bonding piece 22 having a band shape are made smaller than width dimension KW of connection line portion 16.

Terminal electrode 15 described above may be formed of an individual piece. However, terminal electrode 15 is desirably formed into a hoop member as shown in FIG. 7 to enable continuous production and improvement of productivity.

Figure 8:
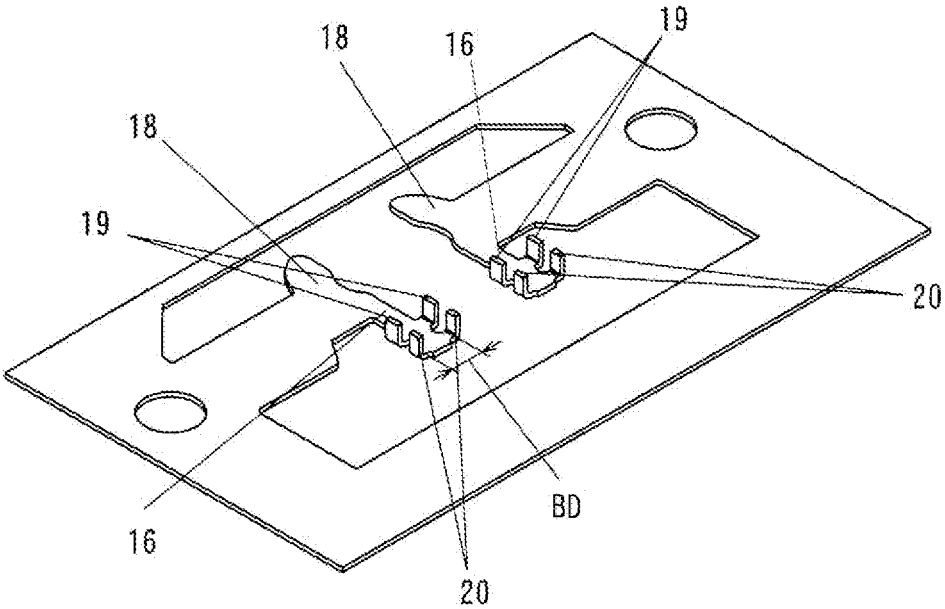
FIG. 8 is a view showing a step of manufacturing the inductor component according to the exemplary embodiment of the present disclosure.

Next, as shown in FIG. 8, the distal end sides of the pair of first bonding pieces 21 and the pair of second bonding pieces 22 shown in FIG. 7 are folded and erected at approximately 90° toward a side on which lead-out portion 13 shown in FIG. 6 is disposed (upper side of the drawing in FIG. 8).

At this time, dimension BD of an inner part between parts to be folded of each of the pair of first bonding pieces 21 and the pair of second bonding pieces 22 is set to be larger in advance than maximum dimension WD of lead-out portion 13 in an elongating direction of first bonding pieces 21 and second bonding pieces 22 before the pair of first bonding pieces 21 and the pair of second bonding pieces 22 are folded.

Figure 9:
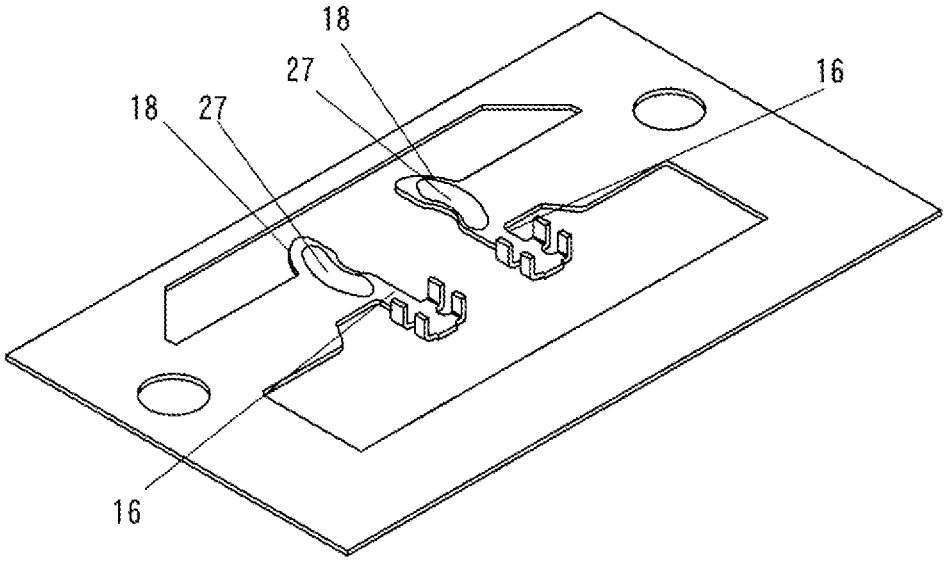
FIG. 9 is a view showing a step of manufacturing the inductor component according to the exemplary embodiment of the present disclosure.
Figure 10:
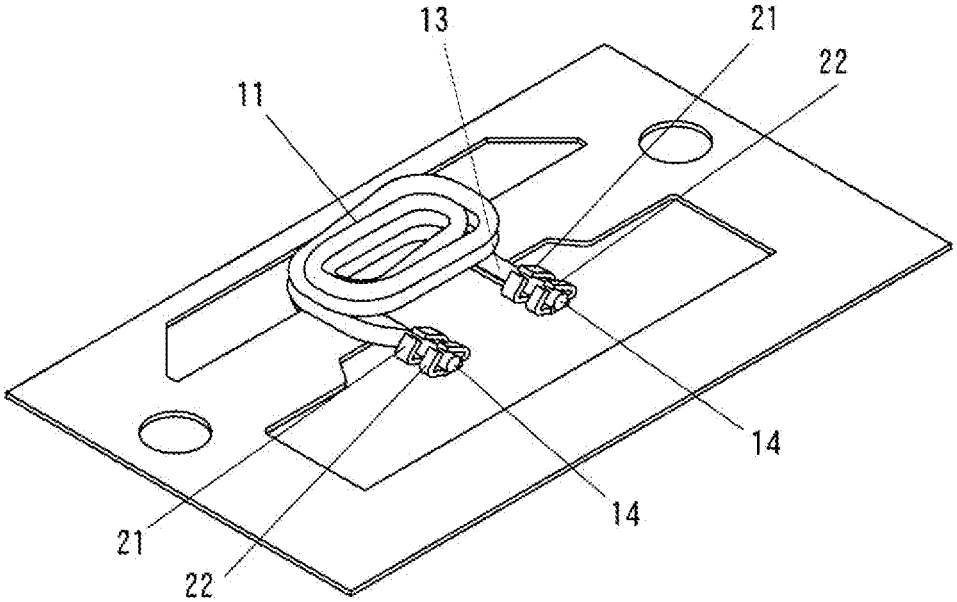
FIG. 10 is a view showing a step of manufacturing the inductor component according to the exemplary embodiment of the present disclosure.

Next, as shown in FIGS. 9 and 10, adhesive 27 is applied to coil fixing portion 18, and coil portion 11 is disposed on coil fixing portion 18 in such a manner that lead-out portion 13 and connection line portion 16 overlap each other to fix coil portion 11 on coil fixing portion 18.

Figure 11A:
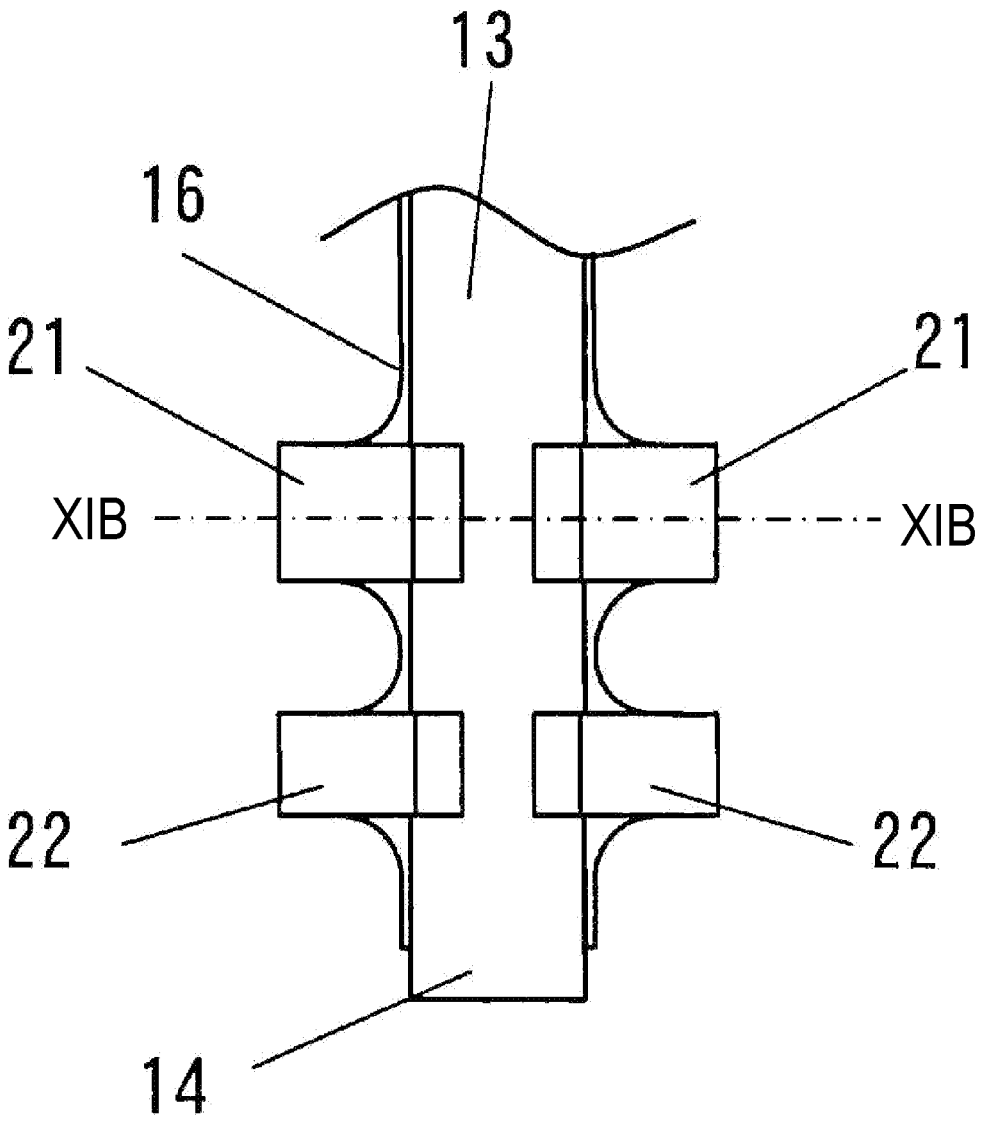
FIG. 11A is an enlarged plan view of a lead-out portion and a connection line portion in FIG. 10.
Figure 11B:
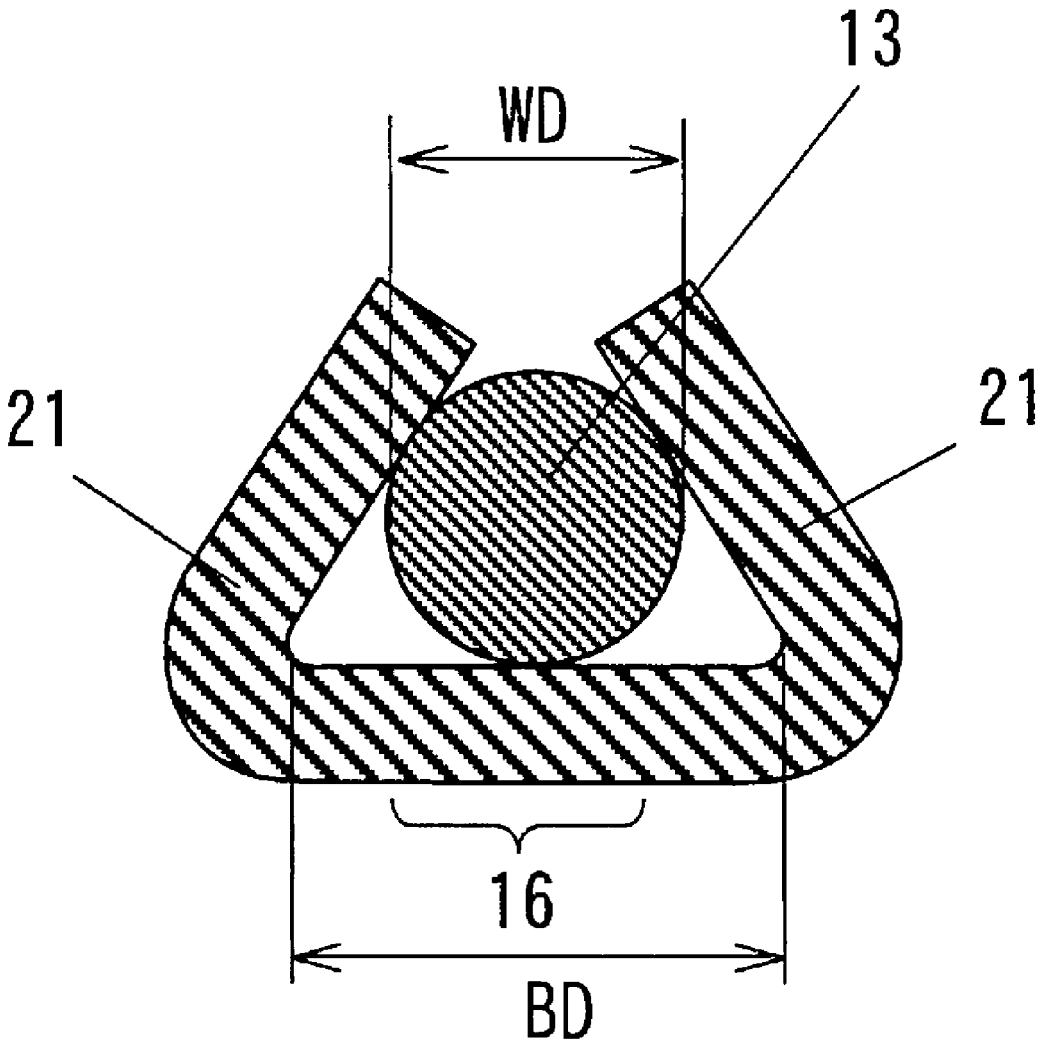
FIG. 11B is a cross-sectional view taken along line XIB-XIB of FIG. 11A.

Then, as shown in FIGS. 10, 11A, and 11B, the distal end sides of each of the pair of first bonding pieces 21 and the pair of second bonding pieces 22 are folded in such a manner that the distal end sides are folded back toward the part of lead-out portion 13 on the opposite side from connection line portion 16, whereby the distal end sides of first bonding pieces 21 and second bonding pieces 22 are brought into contact with lead-out portion 13 to lock lead-out portion 13 at connection line portion 16.

Here, FIG. 11A is a partially enlarged view of lead-out portion 13 and connection line portion 16 after first bonding pieces 21 and second bonding pieces 22 are folded, and is a plan view of lead-out portion 13 viewed from the opposite side of connection line portion 16. Moreover, FIG. 11B is a cross-sectional view taken along line XIB-XIB of FIG. 11A.

By so doing, as shown in FIG. 8, each dimension BD of the inner part between parts to be folded on the distal end sides of the pair of first bonding pieces 21 and the distal end sides of the pair of second bonding pieces 22 has already been set to be larger than maximum dimension WD of lead-out portion 13 in the elongating direction of first bonding pieces 21 and second bonding pieces 22. Then, first bonding pieces 21 and second bonding pieces 22 are folded and erected toward a side on which lead-out portion 13 is disposed. Therefore, through merely folding the distal end sides of first bonding pieces 21 and second bonding pieces 22 in such a manner that the distal end sides are folded back toward lead-out portion 13 from both outer sides of lead-out portion 13, the distal end sides can be brought into contact with the part of lead-out portion 13 on the opposite side from connection line portion 16, thereby being locked.

In addition, as shown in FIG. 11A, in a plan view of lead-out portion 13 viewed from the opposite side of connection line portion 16, the distal ends of first bonding pieces 21 and second bonding pieces 22 can be disposed close to each other in the inner part of lead-out portion 13. Accordingly, during welding by means of laser welding described later, an irradiation range of laser beam can be narrowed.

Therefore, as shown in FIG. 11B, an internal angle of the folded part of first bonding piece 21 becomes an acute angle and first bonding piece 21 pushes lead-out portion 13 from both sides. As a result, lead-out portion 13 can be locked at a position closer to a center of connection line portion 16 in a stable manner and the irradiation range of laser beam can be further narrowed.

Figure 12:
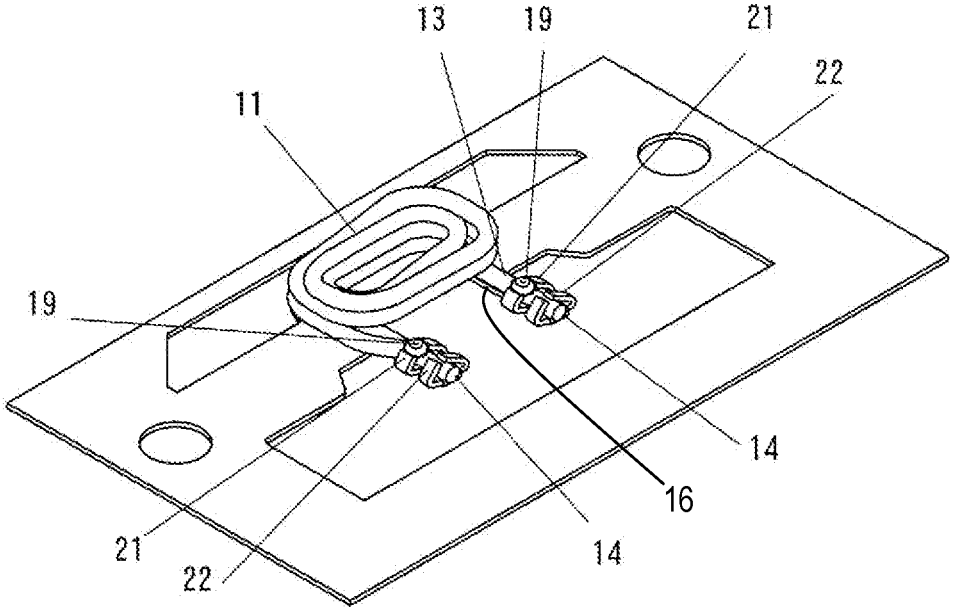
FIG. 12 is a view showing a step of manufacturing the inductor component according to the exemplary embodiment of the present disclosure.

Next, as shown in FIG. 12, the part of lead-out portion 13 on the opposite side from connection line portion 16 and the distal end parts of the pair of first bonding pieces 21 are welded and connected by means of laser welding to form first bonding portion 19.

At this time, as described in FIG. 7, width dimension CW of first bonding piece 21 is made smaller than width dimension KW of connection line portion 16.

By so doing, the amount of heat of the distal end parts of first bonding pieces 21 during laser welding can be reduced in comparison with connection line portion 16. Therefore, only a part of the part of lead-out portion 13 on the opposite side from connection line portion 16 and the distal end parts of first bonding pieces 21 can be partially melted, whereby first bonding portion 19 can be formed.

Furthermore, as described in FIGS. 11A and 11B, as the distal ends of the pair of first bonding pieces 21 are disposed closer to each other, lead-out portion 13 is locked at a position closer to the center of connection line portion 16 in a stable manner. As a result, the irradiation range of laser beam can be further narrowed and thus the amount of heat during laser welding can be reduced.

Furthermore, since the amount of heat during laser welding during formation of first bonding portion 19 can be reduced, deterioration in the insulating film of lead wire 12 can also be suppressed.

Figure 13:
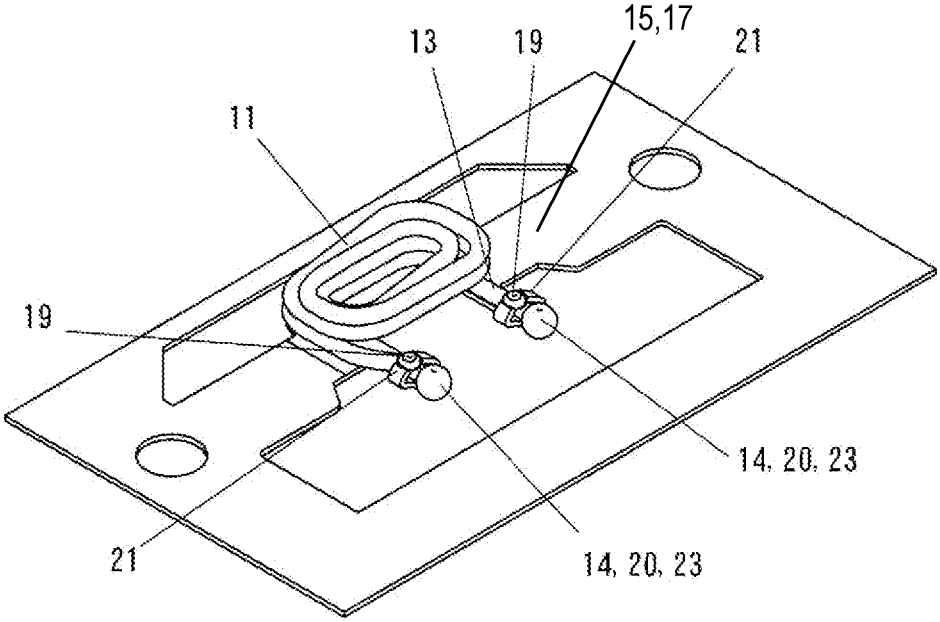
FIG. 13 is a view showing a step of manufacturing the inductor component according to the exemplary embodiment of the present disclosure.

Next, as shown in FIG. 13, after formation of first bonding portion 19, terminal 14 of lead-out portion 13 and connection line portion 16 including second bonding piece 22 shown in FIG. 12 are welded by means of laser welding to form second bonding portion 20 in which terminal 14 of lead-out portion 13 and connection line portion 16 including second bonding piece 22 become melted ball 23.

At this time, an amount of heat of laser welding during formation of second bonding portion 20 is larger than an amount of heat during formation of first bonding portion 19.

However, as shown in the present exemplary embodiment, since second bonding portion 20 is formed after formation of first bonding portion 19, heat generated during formation of second bonding portion 20 is released from first bonding portion 19, which has been formed earlier, to terminal electrode 15 through first bonding piece 21 and connection line portion 16. As a result, deterioration in the insulating film of lead wire 12 can be suppressed.

Figure 14:
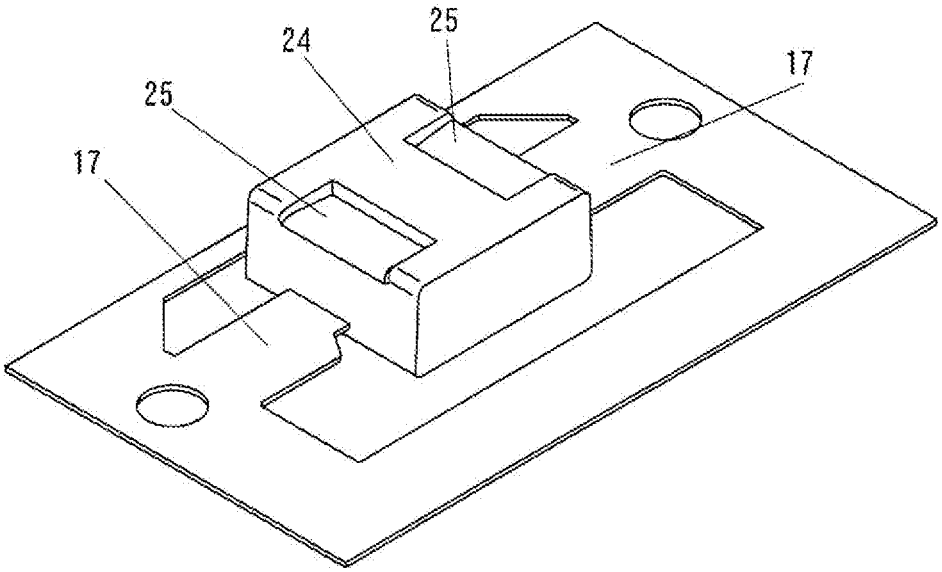
FIG. 14 is a view showing a step of manufacturing the inductor component according to the exemplary embodiment of the present disclosure.

Next, as shown in FIG. 14, except a part of outer terminal portion 17 of terminal electrodes 15, coil portion 11, lead-out portions 13, connection line portions 16 and coil fixing portions 18 of terminal electrode 15, and a magnetic material including a mixture of soft magnetic body powder and resin are disposed inside a mold cavity (not shown) to form mold body 24.

Outer terminal portions 17 are formed so as to protrude from side surfaces of mold body 24. Accommodating recessed portions 25 in which outer terminal portions 17 are to be disposed are formed on the bottom surface of mold body 24.

In the present exemplary embodiment as described above, as mentioned previously, with respect to stress during formation through embedding of coil portion 11 and connection line portion 16 in the magnetic material containing soft magnetic body powder and resin, the two connecting parts, i.e., first bonding portion 19 and second bonding portion 20, prevent lead-out portion 13 from coming off of connection line portion 16. As a result, even miniaturized inductor component 30 can configure coil-embedded inductor component 30.

A molding method for forming mold body 24 includes molding methods such as injection molding, transfer molding, and compression-molding using granulated powder containing a mixture of soft magnetic body powder and resin made into granules.

Figure 15:
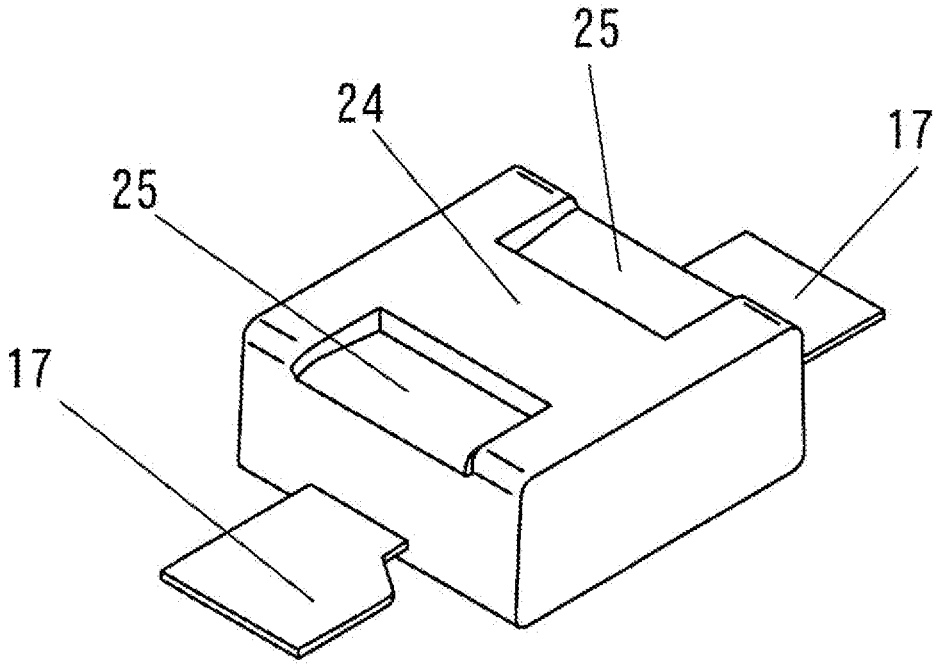
FIG. 15 is a view showing a step of manufacturing the inductor component according to the exemplary embodiment of the present disclosure.
Figure 16:
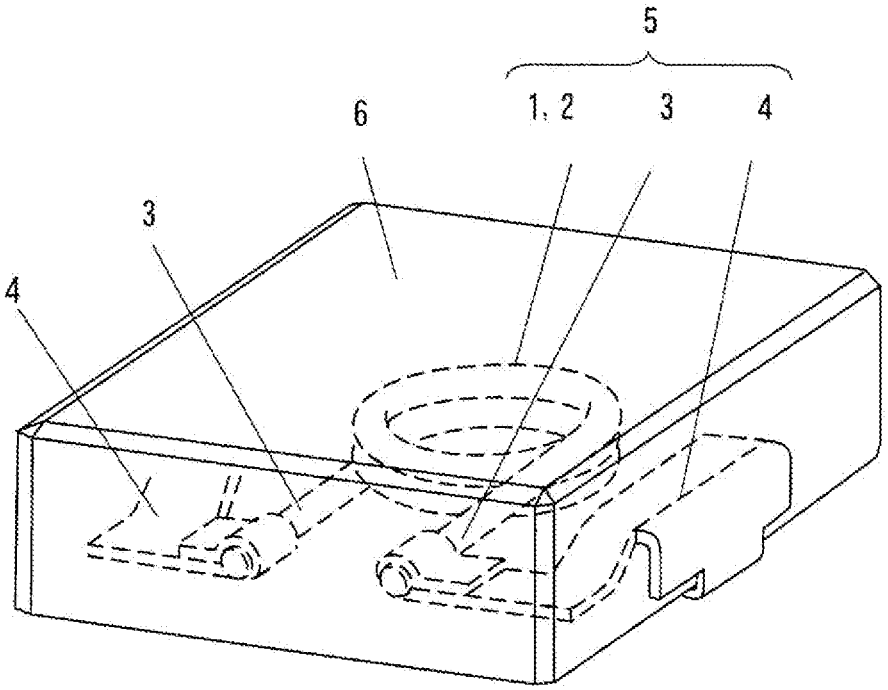
FIG. 16 is a transparent perspective view of a top surface side of a conventional inductor component.

Next, as shown in FIG. 15, outer terminal portion 17 is cut into a predetermined length and is coated with a solder or the like as needed.

Finally, outer terminal portion 17 is folded toward the bottom surface from a side of mold body 24 and is disposed in accommodating recessed portion 25 that has been formed on the bottom surface of mold body 24 so as to obtain coil-embedded inductor component 30 shown in FIGS. 1 to 4.

Note that in the method for manufacturing the inductor component of the present exemplary embodiment described above, a description has been given with an example of providing second bonding piece 22. However, terminal 14 of lead-out portion 13 may be welded with connection line portion 16 by means of laser welding, instead of providing second bonding piece 22, in which case a similar effect to the present exemplary embodiment can be obtained.

Second bonding piece 22 is desirably provided. This enables terminal 14 of lead-out portion 13 and connection line portion 16 to come into contact with each other in an accurate manner, whereby laser welding can be performed in a stable manner.

In a case where second bonding piece 22 is provided, width dimension EW of second bonding piece 22 is desirably made smaller than width dimension CW of the first bonding piece 21. This enables reduction in the amount of heat of laser welding during formation of second bonding portion 20.

The configuration of the inductor component and the method for manufacturing the inductor component according to the present disclosure are capable of suppressing a decrease in connecting reliability between a lead-out portion of a coil and a connection line portion of a terminal electrode due to miniaturization of an inductor component. In addition, heat deterioration in an insulating film of a lead wire during connection between the lead-out portion and the connection line portion can be suppressed and thus the inductor component and the method for manufacturing the inductor component are industrially useful.

The invention claimed is:

1. A method for manufacturing an inductor component, the method comprising:

a step of forming a coil portion through winding of a lead wire and forming a lead-out portion including an end portion of the lead wire led out in an outer direction of the coil portion;

a step of forming a terminal electrode through die-cutting of a metal plate, the terminal electrode including a connection line portion connected to the lead-out portion and an outer terminal portion to be connected to an outer circuit integrally with the lead-out portion;

a step of locking the lead-out portion at the connection line portion;

a step of connecting the lead-out portion to the connection line portion; and a step of forming a mold body containing a magnetic material and including the coil portion and the connection line portion embedded and the outer terminal portion exposed, wherein the connection line portion elongates along the lead-out portion, and is formed into a shape having a pair of first bonding pieces in a position corresponding to a position between the coil portion and a terminal of the lead-out portion, the pair of first bonding pieces extending from both sides of the connection line portion in mutually opposite directions, the step of locking the lead-out portion at the connection line portion includes locking the lead-out portion at the connection line portion through folding of each of distal end sides of the pair of first bonding pieces toward a part of the lead-out portion on an opposite side from the connection line portion, and the step of connecting the lead-out portion to the connection line portion includes fusing and connecting the part of the lead-out portion on the opposite side from the connection line portion to a distal end part of the first bonding piece by means of laser welding, and welding the terminal of the lead-out portion to the connection line portion by means of laser welding.

2. The method for manufacturing an inductor component according to claim 1, wherein a dimension of an inner part between parts folded of the pair of first bonding pieces is made larger than a maximum dimension of the lead-out portion in an extending direction of the first bonding pieces.

3. The method for manufacturing an inductor component according to claim 1, wherein on the connection line portion, a pair of second bonding pieces is integrally formed on a terminal side of the lead-out portion at a space from the first bonding pieces, the pair of second bonding pieces extending from both sides of the connection line portion in mutually opposite directions, the pair of second bonding pieces has distal end sides of the pair of second bonding pieces each folded toward a part of the lead-out portion on the opposite side from the connection line portion to lock the terminal side of the lead-out portion at the connection line portion, and the terminal of the lead-out portion and the connection line portion including the second bonding pieces are welded by means of laser welding.

4. The method for manufacturing an inductor component according to claim 3, wherein a width dimension of the second bonding piece in an extending direction of the lead-out portion is smaller than a width dimension of the first bonding piece.

5. An inductor component comprising:

a coil portion;

a lead-out portion;

a connection line portion;

a terminal electrode; and a mold body, wherein the coil portion is formed with a lead wire wound, the lead-out portion is formed with an end portion of the lead wire led out in an outer direction of the coil portion, the connection line portion is comprised of a metal plate and has a shape elongated along the lead-out portion, the terminal electrode has an outer terminal portion that is integrally formed with the connection line portion and is to be connected to an outer circuit, the mold body contains a magnetic material, and includes the coil portion embedded, the connection line portion embedded, and the outer terminal portion exposed, the connection line portion further has a shape elongating along the lead-out portion, and includes a pair of first bonding pieces between the coil portion and a terminal of the lead-out portion, the pair of first bonding pieces elongating from both sides of the connection line portion in mutually opposite directions, the pair of first bonding pieces each has a distal end side of the first bonding piece folded toward a part of the lead-out portion on an opposite side from the connection line portion, and the lead-out portion and the connection line portion are connected by means of fusion bonding between the part of the lead-out portion on the opposite side from the connection line portion and a distal end part of the first bonding piece and by means of welding between the terminal of the lead-out portion and the connection line portion.

6. The inductor component according to claim 5, wherein a dimension of an inner part between parts folded of the pair of first bonding pieces is larger than a maximum dimension of the lead-out portion in an elongating direction of the first bonding pieces.

* * * * *